US006606840B2

(12) United States Patent
Focke et al.

(10) Patent No.: US 6,606,840 B2
(45) Date of Patent: Aug. 19, 2003

(54) PROCESS AND APPARATUS FOR PRODUCING (CIGARETTE) PACKS

(75) Inventors: Heinz Focke, Verden (DE); Hans-Jürgen Bretthauer, Bremen (DE); Henry Buse, Visselhövede (DE); Hermann Blome, Blender-Einste (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/757,956

(22) Filed: Jan. 10, 2001

(65) Prior Publication Data

US 2001/0007187 A1 Jul. 12, 2001

(30) Foreign Application Priority Data

Jan. 10, 2000 (DE) ..... 100 00 697

(51) Int. Cl.[7] ..... B65B 49/00

(52) U.S. Cl. ..... 53/461; 53/234; 53/228; 53/466; 53/463

(58) Field of Search ..... 53/209, 228, 234, 53/412, 174, 449, 461, 133.3, 466, 463

(56) References Cited

U.S. PATENT DOCUMENTS

| | | | | |
|---|---|---|---|---|
| 4,202,151 A | | 5/1980 | Focke | |
| 4,962,628 A | * | 10/1990 | Boldrini et al. | 53/462 |
| 5,154,035 A | * | 10/1992 | Cavazza | 53/234 |
| 5,168,690 A | * | 12/1992 | Quadrana | 493/911 |
| 6,036,006 A | * | 3/2000 | Focke | 206/264 |
| 6,047,529 A | * | 4/2000 | Draghetti | 53/234 |
| 6,125,611 A | * | 10/2000 | Focke | 53/225 |

FOREIGN PATENT DOCUMENTS

| | | | |
|---|---|---|---|
| DE | 2447917 | | 7/1975 |
| DE | 3818622 | A1 | 1/1989 |
| DE | 4338945 | A1 | 5/1994 |
| DE | 19541541 | A1 | 5/1997 |
| DE | 19602192 | A1 | 7/1997 |
| DE | 19733604 | A1 | 4/1999 |
| DE | 19733794 | A1 | 11/1999 |
| EP | 0344674 | A1 * | 12/1989 |
| EP | 0 751 069 | A | 1/1997 |
| EP | 0863079 | A1 | 9/1998 |
| GB | 2 206 327 | A | 1/1989 |
| WO | WO 98/22367 | | 5/1998 |
| WO | WO 99/28212 | | 6/1999 |

* cited by examiner

*Primary Examiner*—Rinaldi I. Rada
*Assistant Examiner*—Thanh Truong
(74) *Attorney, Agent, or Firm*—Thomas, Kayden Horstemeyer & Risley, L.L.P.; Todd Deveau

(57) ABSTRACT

In order to produce (cigarette) packs with an (inner) wrapper made of heat-sealable sheet material and with folding tabs which are connected to one another by sealing, first of all a cigarette group (11) is enclosed by a wrapper blank and. following completion of the necessary folding operations, is fed to a sealing turret (48). In the region of the latter, folding tabs on sideways directed side walls and on radially outwardly directed end walls of the folded wrapper are sealed.

16 Claims, 9 Drawing Sheets

Fig.4
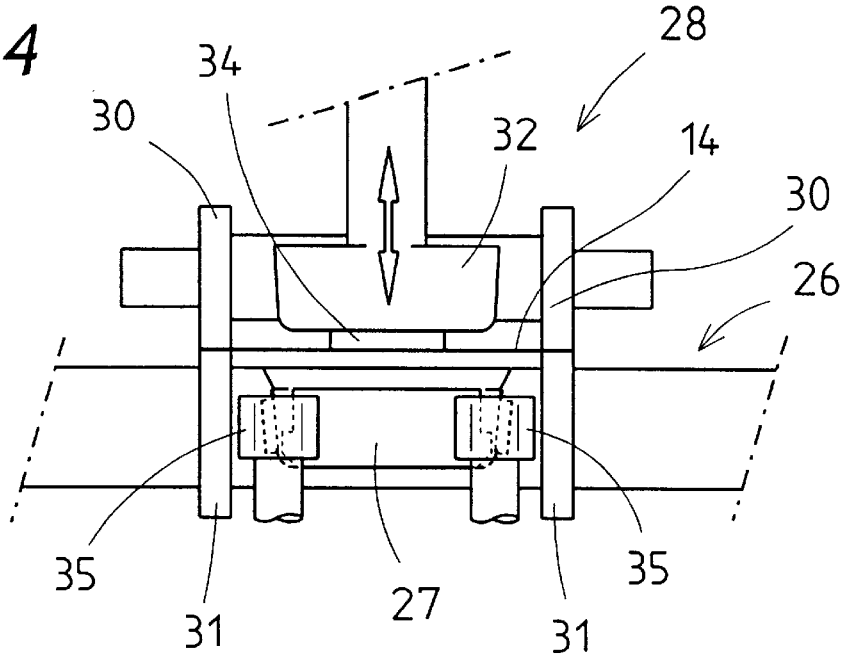
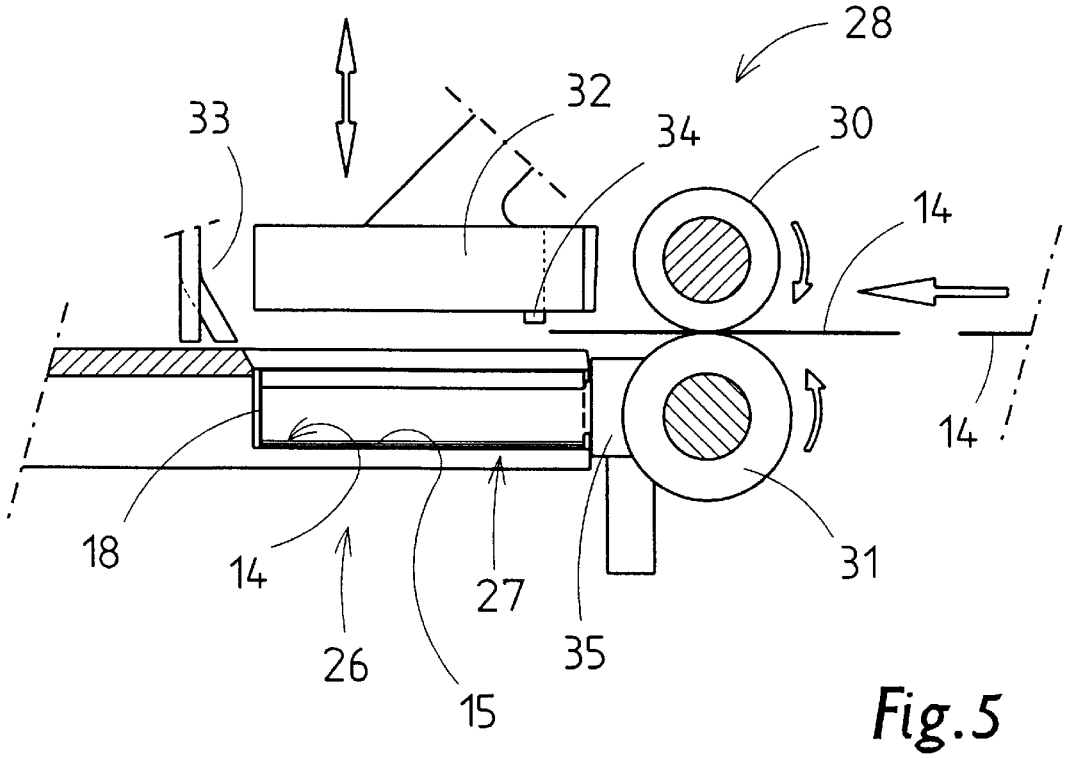
Fig.5

12
13
42
43
44
45
46
47
49
50
54
55
56
57

PROCESS AND APPARATUS FOR PRODUCING (CIGARETTE) PACKS

This is a priority application based upon German patent application 100 00 697.3, filed Jan. 10, 2000.

FIELD OF THE INVENTION

The invention relates to a process for producing packs with an (inner) wrapper made of heat-sealable sheet material and with folding tabs which are connected to one another by sealing, in particular for producing a cigarette block for hinge-lid boxes, the pack contents—a cigarette group—preferably being enclosed by a supporting insert made of thin cardboard. The invention also relates to an apparatus for producing such or similar packs.

BACKGROUND OF THE INVENTION

The invention primarily involves the production of packs in accordance with WO 98/22367. With this type of pack, the pack contents, namely the cigarette group, is enclosed by a sealed inner wrapper with folding tabs which are connected by heat sealing. For opening the pack and/or the cigarette block, the latter is provided on the front side with an opening flap defined by weakening lines of the material. Provided In the region of said opening flap is an adhesive-bonding closure tape, which ensures that the cigarette block can be opened, and if appropriate, closed again. The application of heat and pressure to the sheet material of the (inner) wrapper is problematic for sensitive pack contents, such as cigarettes. For this purpose, there is arranged within the cigarette block a supporting insert which consists of thin cardboard and encloses the cigarette group in the region of those surfaces which are subjected to the action of heat and pressure in order for folding tabs to be sealed.

SUMMARY OF THE INVENTION

The object of the invention is to propose a process and apparatus for producing this type of (cigarette) pack and for producing similar packs.

In order to achieve this object, the process according to the invention is characterized by the following features:

a) a blank for the supporting insert is positioned partially around the cigarette group in the form of a U at least in the region of a front side and in the region of long side surfaces by U-shaped folding.

b) then a sheet-material blank made of heat-sealable sheet material is folded around the unit comprising the cigarette group and supporting insert, c) thereafter, the folding tabs of the (inner) wrapper or of the sheet-material blank are connected to one another by heat sealing.

d) the resulting cigarette block is pushed into a pack, in particular a hinge-lid box.

If the sealed sheet material or inner wrapper is provided with a closure tape, this, according to a further proposal of the invention, is applied in a precisely positioned manner to the continuous material web for producing the sheet-material blanks, and then the sheet-material blanks are severed from the web prepared in this way.

The apparatus according to the invention comprises a continuous pack path, in the region of which there are arranged conveying, folding and sealing elements for producing and sealing the pack and/or the cigarette block.

A special feature is the folding and sealing of the (inner) wrapper, namely the formation of an end wall from end-wall tabs which are folded in a specific manner and the sealing of the wrapper such that the geometrical shape of the same is taken into account.

BRIEF DESCRIPTION OF THE DRAWINGS

Further details and features of the invention are explained more specifically hereinbelow with reference to the drawings, in which;

FIG. 4 shows a detail of the folding turret according to FIG. 3, namely a plan view of a push-in station in accordance with arrow IV in FIG. 3.

FIG. 5 shows the detail according to FIG. 4 in side view and partially in vertical section, in accordance with arrow V in FIG. 3.

DETAILED DESCRIPTION OF THE DRAWINGS

Figure 1:
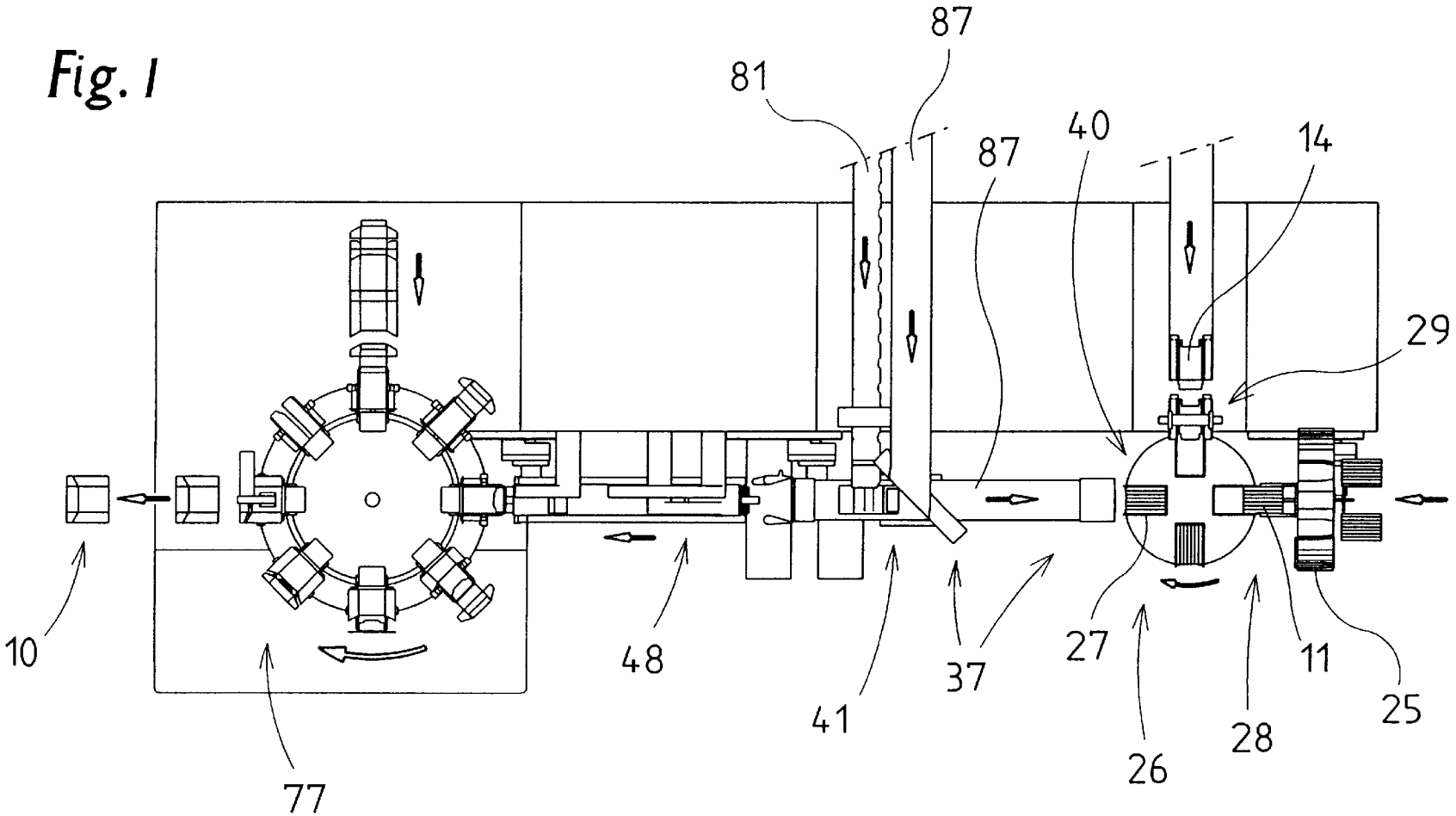
FIG. 1 shows a plan view of an apparatus for producing hinge-lid boxes for cigarettes.

The examples illustrated in the drawings concern the production of cigarette packs 10 of the hinge-lid box type. The pack contents are thus formed by a cigarette group 11. The latter is enclosed by a sheet-material blank which forms an (inner) wrapper for the cigarette group 11. The sheet-material blank or the wrapper 12 is preferably a multi-layered, sealed sheet material, which can be heat-sealed at the same time. Alternatively, it is also possible for the wrapper 12 to constitute the definitive or outer packaging. The cigarette group 11 with wrapper 12 forms a cigarette block 13 as contents of the hinge-lid box or cigarette pack 10. Alternatively, it is also possible for the wrapper 12 to be an outer wrapper of a corresponding cigarette pack.

Part of the cigarette block 13 is formed by a supporting insert 14 arranged within the same. Said supporting insert protects the cigarette group 11 within the cigarette block 13 against the effects of heat and pressure during the heat sealing of folding tabs. In the present case, the supporting insert 14 forms a front wall 15, side tabs 16, 17 and a base wall 18. Also provided, in continuation of the side tabs 16, 17, are end tabs 19, 20, which can be folded into the plane of an end wall within the cigarette block 13. In a region which is directed towards the top side and/or end wall, the front wall 15 forms a cutout 21 corresponding to the cutout of a collar which is conventional in hinge-lid boxes.

The supporting insert 14 formed in this way is folded around the cigarette group 11 in the region of a front surface, in the region of narrow, upright side surfaces and in the region of a base surface. The resulting unit comprising the cigarette group 11 and supporting insert 14 is then enclosed by the sheet-material blank, the wrapper 12 and/or the cigarette block 13 being formed in the process. Folding tabs of the wrapper 12 which overlap one another wholly or partially are connected to one another by heat sealing. The cigarette block 13 is then pushed into the cigarette pack 10. In the present example, the supporting insert 14 is designed such that edges between the front wall 15, on the one hand, and side tabs 16, 17, on the other hand, are designed as round edges 22, 23. These comprise a plurality of parallel, stamped grooves which, when the side tabs 16, 17 are folded transversely to the front wall 15, form rounded edges, that is to say round edges 22, 23.

The apparatus for producing the above pack and/or the cigarette block 13 comprises a plurality of elements and subassemblies which are positioned in a coordinated manner along a rectilinear pack path 24. The cigarette groups 11 are fed at the start of said pack path 24, to be precise by being pushed out of a conventional cigarette turret 25. The latter is connected to a likewise conventional cigarette magazine (not shown). The cigarette group 11 is pushed out of the cigarette turret 25 and into a first folding turret 26. The latter is of specific design, that is to say it comprises a flat plate which rotates about a vertical axis (in the clockwise direction). A plurality of, namely four, pockets 27 are arranged in said plate. These pockets are depressions in the plate which are open at the top and on the radially outwardly located sides and correspond to the size of the cigarette group 11. The four pockets 27 are arranged such that they run through a plurality of stations one after the other, steps being carried out, during the standstill of the folding turret 26, in the region of each pocket 27. In the region of a push-in station 28, the cigarette group is pushed radially, as a unit, into the pocket 27 positioned there.

In an upstream blank station 29, as seen in the direction of rotation, the blank for the supporting insert 14 is pushed, likewise radially, into a pocket 27 which is held at the ready, said supporting insert being prefolded at the same time.

The supporting insert 14, which arrives on a radially directed blank path, is gripped by two pairs of conveying rollers 30, 31 in the region of the folding turret 26 and transported into a region above the pocket 27. The conveying rollers 30, 31 act in each case in a border region of the sideways directed side tabs 16, 17. The dimensions are selected such that, in the end position, the region of the front wall 15 is located centrally above the pocket 27.

An introduction element, namely a ram 32, is located in a plane above where the supporting inserts 14 are fed. Said ram grips the blank positioned above the pocket 27, by way of a downward movement, and forces it into the upwardly open pocket. In this case, the side tabs 16, 17 are folded into an upright position by side walls of the pocket 27, the round edges 22, 23 being formed in the process, with the result that the supporting insert 14 is positioned in the form of a U in the pocket 27. In this case, the base wall 18—located on the inside in the radial direction—is likewise folded into an upright position. The folding movement is assisted by a guide element 33, which is positioned at the end of the pocket 27, above the folding turret 26, and has a guide surface which is intended for the base wall 18 and is directly obliquely and/or in a funnel-shaped manner in relation to the pocket.

In order to ensure precise relative positioning of the supporting insert 14 in the pocket 27—namely on the base of the same—use is made of an adjusting extension 34 on the underside of the ram 32. Said adjusting extension passes into the region of the cutout 21 of the supporting insert 14, butting against an edge of the blank in the process.

In the region of said blank station 29, the end tabs 19, 20 are also folded, albeit into a position in which they are directed outwards in the form of a funnel. For this purpose, use is made of folding rollers 35, which are of segment-like design and fold the end tabs 19, 20 into an outwardly directed position by way of a circumferential surface, as a result of rotation about a vertical axis.

Following a return of the ram 32, which can be moved up and down, into the top position outside the pocket 27 (FIG. 5), the pocket 27, with the supporting insert 14, is conveyed into the push-in station 28 by corresponding rotation of the folding turret 26. The cigarette group 11 is then pushed into the pocket 27 and/or into the prefolded supporting insert 14 by a carry-along element 36 of an endless conveyor 37.

In the following station of the folding turret 26, the obliquely directed end tabs 19, 20 are folded, to be precise by tangentially movable folding fingers 38, 39 on both sides of the pocket 27.

In the region of a following push-out station 40, the finished unit comprising the cigarette group 11 and supporting insert 14 is pushed out of the folding turret 26 in the radial direction and transported further by the conveyor 37.

Figures 13, 14:
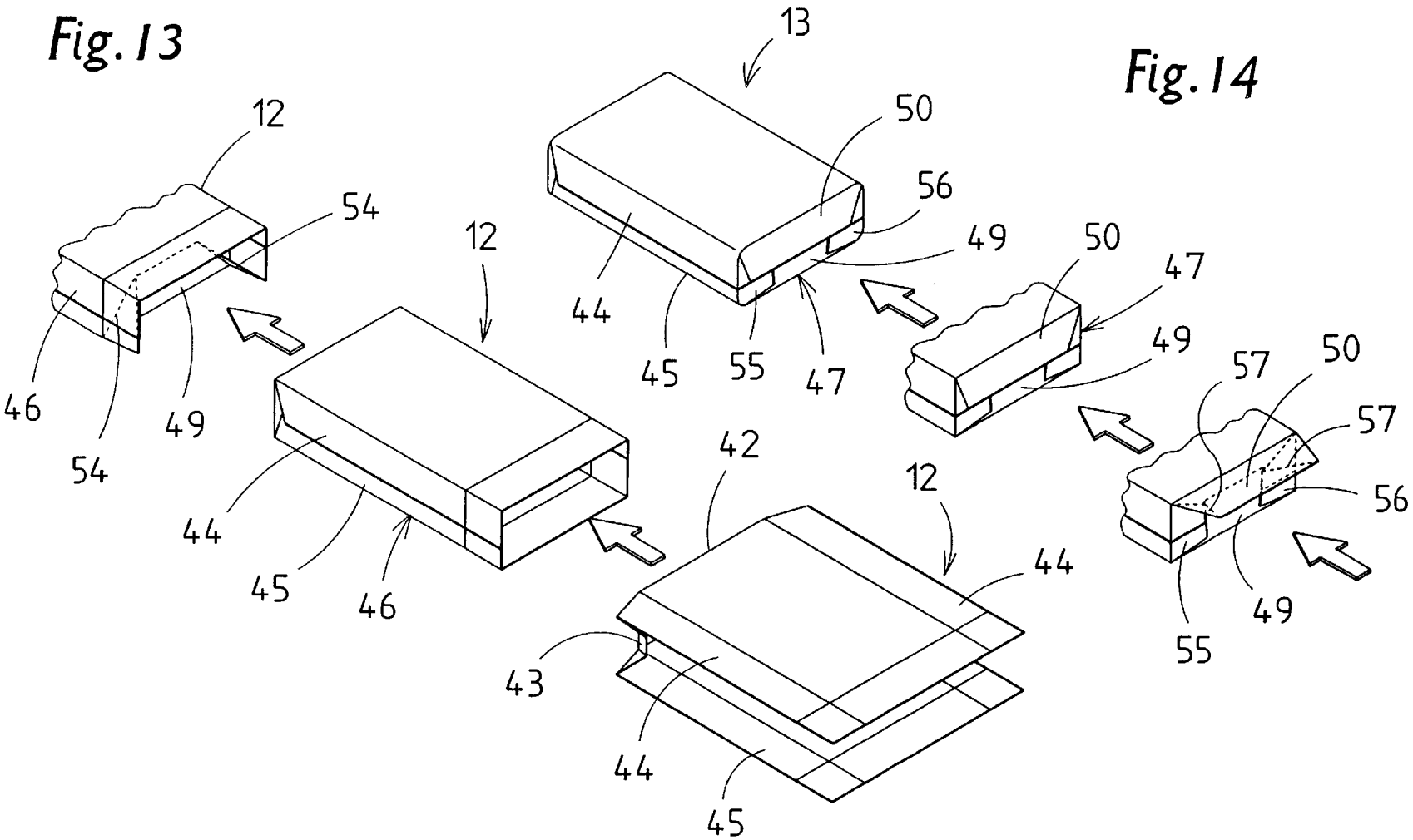
FIG. 13 and FIG. 14 show a perspective illustration of phases of the production of an (inner) wrapper, namely folding steps in the region of an end wall.

The unit comprising the cigarette group 11 and supporting insert 14 is conveyed through a blank station 41. In the region of the latter, a blank of the (inner) wrapper 12 is held at the ready such that the blank is gripped by the transported cigarette group 11, and is folded in the form of a U in the process. The wrapper 12 is folded here such that a front base wall 42, as seen in the conveying direction, wraps the cigarette group 11—with supporting insert 14—from the front ends or from the base wall 18 (FIG. 13). At the same time, a further folding step is carried out on the wrapper 12, namely the step of folding in base-side corner tabs 43. As transportation continues, side tabs 44, 46 are folded, two narrow side walls 46 of the wrapper 12 being formed in the process. Thereafter, by corresponding steps, a rear end wall 47, as seen in the transporting direction, is folded (FIG. 14).

The folding of the end wall 47 takes place essentially on a folding platform 78 during the operation of pushing into a (sealing) turret 48. The folding platform is expediently designed here in accordance with U.S. Pat. No. 4,612,756.

As folding element for top and bottom folding tabs of the end wall 47, namely longitudinal tabs 49, 50, use is made, on the one hand, of a folder 53 which is designed as an angled lever and is positioned pivotably beneath the movement path of the cigarette block 13. As a further folding element, use is made of a pusher 51 for conveying the cigarette block into a pocket 52 of the sealing turret 48.

The folding of the end wall 47 can be carried out in a conventional manner. A special feature, however, is the production and configuration of the end wall 47 according to FIGS. 13 and 14. According to these figures, first of all the inner (bottom) longitudinal tab 49 is folded, namely until it butts against the pack contents. In this case, triangular folding gussets 54 are also folded into an intermediate folding position as a transition between the longitudinal tab 49 and projections of the blank as an extension of the side walls 46. These projections are folded next, corner tabs 55, 56 being formed in the process. Said corner tabs have a sub-region butting against the previously folded inner longitudinal tab 49, the folding gussets 54 extending between the longitudinal tab 49 and the corner tabs 55, 56. The corner tabs 55, 56 likewise form triangular folding gussets 57 as a transition to the outer (top) longitudinal tab 50. The latter is folded in a final folding step (FIG. 14). Accordingly, the outer longitudinal tab 50 is likewise of trapezoidal configuration and butts, by way of lateral regions, against the corner tabs 55, 56 and, in the central region, against the inner longitudinal tab 49. This folding principle of the end wall 47 is particularly favorable for heat sealing the folding tabs since, in particular, the outer longitudinal tab 50 covers a relatively large surface area of the end wall 47.

In the region of the sealing turret 48, folding tabs of the cigarette block 13 and/or of the wrapper 12 are fixed by heat sealing. The sealing and construction and functioning of sealing elements constitute a special feature.

The sealing turret 48 is driven cyclically in the counterclockwise direction. Fixed sealing tools 58, 59 are positioned on open end sides of the pocket 52, that is to say on both sides of the sealing turret 48. Said sealing tools are mounted in each case in the axial center of the sealing turret 48 and extend with a segment 60 over virtually half the conveying route of the cigarette blocks 13 in the region of the sealing turret 48. Accordingly, the segments 60 are more or less semicircular.

The sealing tools 58, 59 can be moved back and forth in the axial direction of the sealing turret 48. On the side which is directed towards the pockets 52 and/or the cigarette blocks 13, individual sealing jaws 61, 62 are arranged in each case on the sealing tools 58, 59. Said sealing jaws can each be pressed onto the exposed side surfaces or side walls 46 of the cigarette block 13 in order for the folded side tabs 44, 45 to be sealed. The sealing jaws 61, 62, which perform a first sealing cycle, are designed as strip-like protrusions of the sealing tools 58, 59, to be precise of a somewhat smaller width than that of the side walls 46, with the result that heat and pressure are transmitted merely in the region of the overlap of the side tabs 44, 45. A plurality of these sealing jaws 61, 62 are expediently arranged in the circumferential or conveying direction of the sealing turret 48, with the result that they act on a plurality of cigarette blocks 13 in the pockets 52 in each case during each sealing cycle.

Following the sealing by the sealing jaws 61, 62 over a number of conveying cycles, other sealing jaws, namely shaping jaws 63, 64, come into use. These are likewise arranged as strip-like protrusions on the common sealing tools 58, 59, in the region of the pocket 52 in each case. However, the shaping jaws 63, 64 are designed such that they grip the cigarette block 13 over the entire width during a sealing and shaping cycle and extend into the adjacent surfaces of the cigarette block 13.

Figure 12:
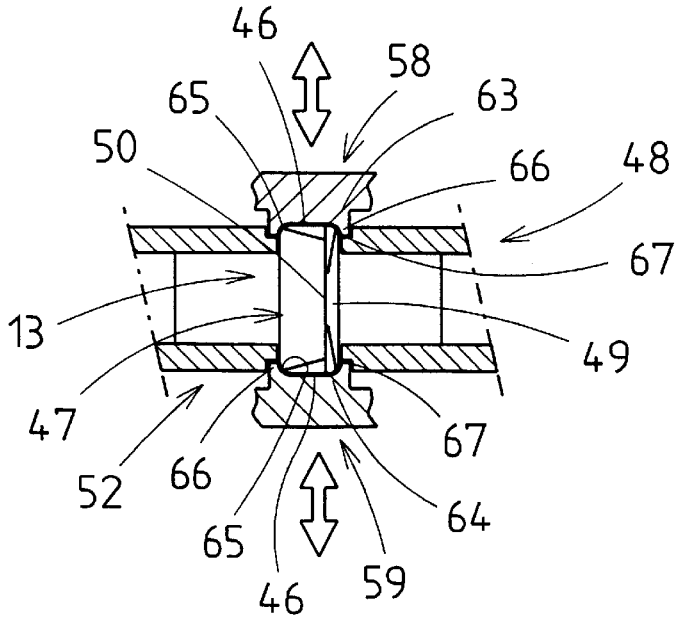
FIG. 12 shows an illustration analogous to FIG. 11, but in a position offset in the circumferential direction of the folding turret.

In the exemplary embodiment according to FIG. 12, a cigarette block 13 which has rounded upright edges, namely round edges 65, is produced. The shaping jaws 63, 64 are contoured correspondingly, namely with a more or less C-shaped sealing and shaping surface. The side walls 46 of the cigarette block 13 are enclosed with a form fit by the shaping jaws 63, 64, the round edges 65 being formed in the process in accordance with the diameter or the rounding of the packaged cigarettes. In this case, lateral protrusions 66 of the shaping jaws 63, 64 pass into cutouts 67 in the boundary of the pockets 52. The shaping jaws 63, 64 thus cause the sealing to be completed, with simultaneous improvement of the outer shape of the cigarette block 13 by heat transmission.

Figure 11:
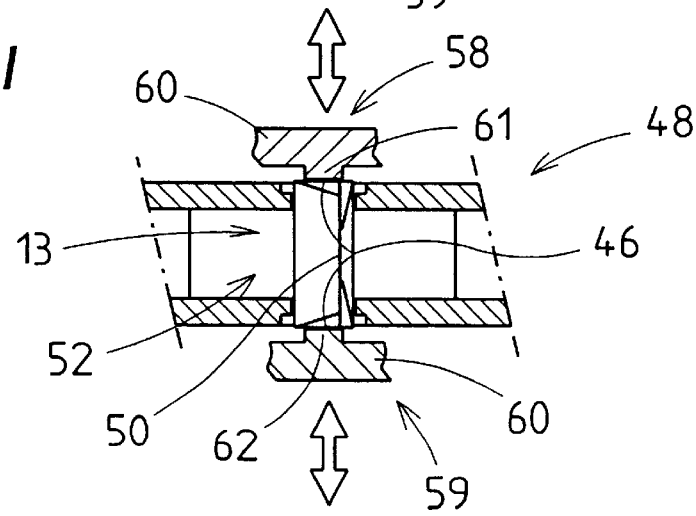
FIG. 11 shows the pocket according to FIG. 10 in cross section and in plan view in accordance with arrow XI in FIG. 10.

In order to improve the sealing effect, there are arranged, in the region of the sealing tools 58, 59, jaws which are designed in the manner of FIGS. 11 and 12 and are not heated, and if appropriate are even cooled, and, accordingly, subject the previously sealed side tabs 44, 45 to a cooling action during each operating cycle of the sealing tools 58, 59. As a result, a particularly effective sealing connection is achieved with careful treatment of the pack contents.

The radially outer end walls 47 are sealed by sealing elements which are arranged in a stationary manner in the outer circumference of the sealing turret 48, but can be moved more or less in the radial direction. In the present exemplary embodiment, there are three such sealing elements 68, 69, 70. These are of circle-arc configuration in accordance with the outer contour of the sealing turret 48. Each sealing element 68, 69, 70 is provided on a pivoting arm 71, 72, 73 for raising up and pressing the sealing elements 68, 69, 70 in each case onto the outwardly directed end walls 47.

Each sealing element 68, 69, 70 is provided with a plurality of protrusions which form sealing jaws 74, approximately in the shape and size of the end wall 47. The sealing element 68 has three such sealing jaws 74, the sealing element 69 has four and the sealing element 70, in turn, has three sealing jaws 74, these being spaced apart from one another in the circumferential direction in each case in accordance with the spacings between the pockets 52. Accordingly, the end wall 47 or the folding tabs thereof are likewise heat-sealed in a number of successive sealing cycles, it being possible, for the above reasons, for individual sealing jaws 74, in particular of the sealing element 70, to have a cooling action.

In the region of a push-out station 75—located diametrically opposite a push-in station—the cigarette blocks 13, which are completely sealed following a semicircular conveying route, are pushed out of the sealing turret 48 by a pusher 76 and transferred directly to a folding turret 77 for an outer wrapper, namely a blank for hinge-lid boxes. Said folding turret produces cigarette packs 10, namely hinge-lid boxes of a known design with the sealed cigarette block 13 as pack contents.

In a cigarette pack and/or a cigarette block 13 configured in accordance with WO 98/22367, an opening aid is formed in the region of a front wall 79, and this aid comprises an adhesive label 80 applied to the outside of the wrapper 12. Said adhesive label is applied, and provided with an adhesive-free grip tab, such that an opening flap of the wrapper 12 can be exposed with the aid of the adhesive label 80.

Figure 2:
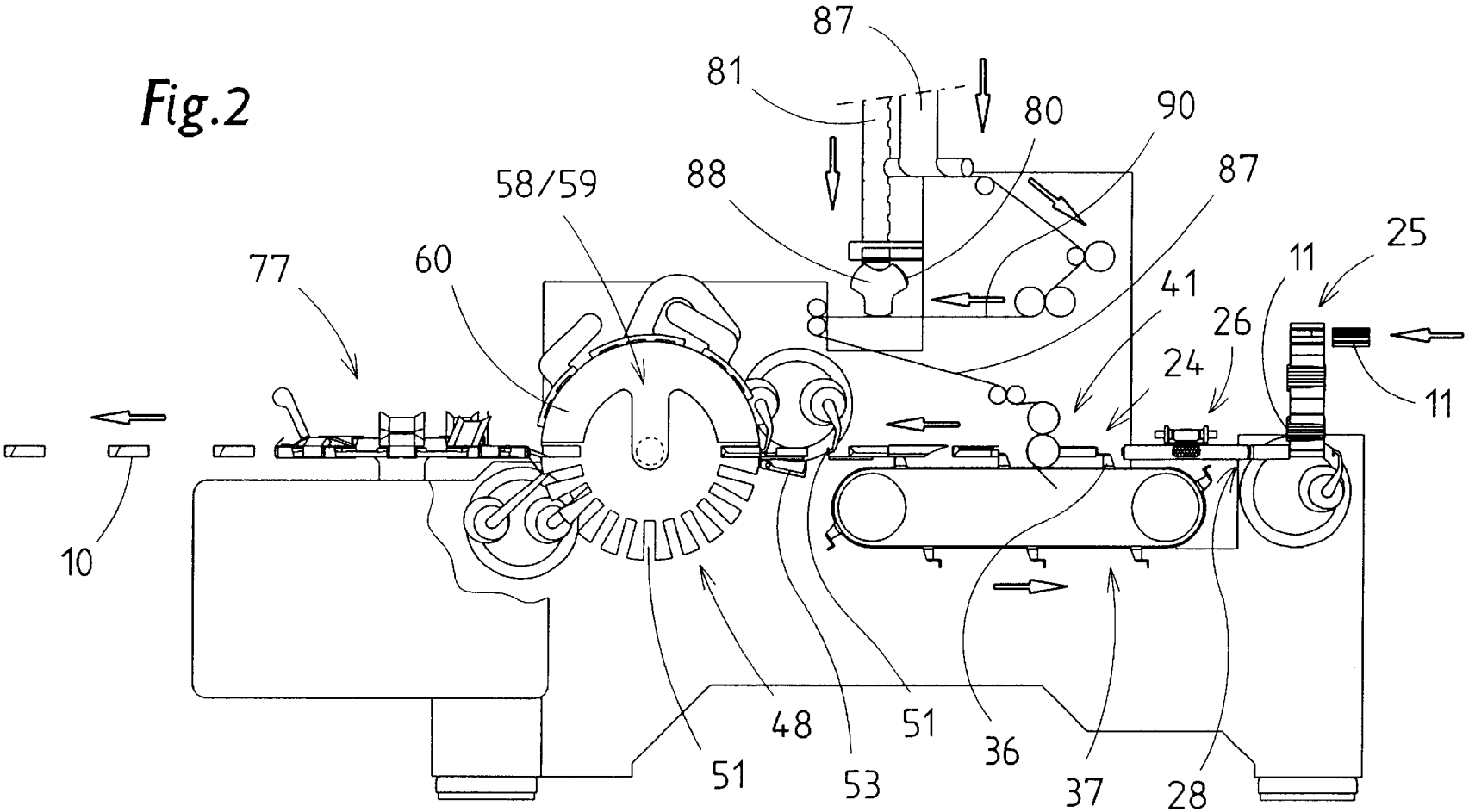
FIG. 2 shows a side view of the apparatus according to FIG. 1.
Figure 3:
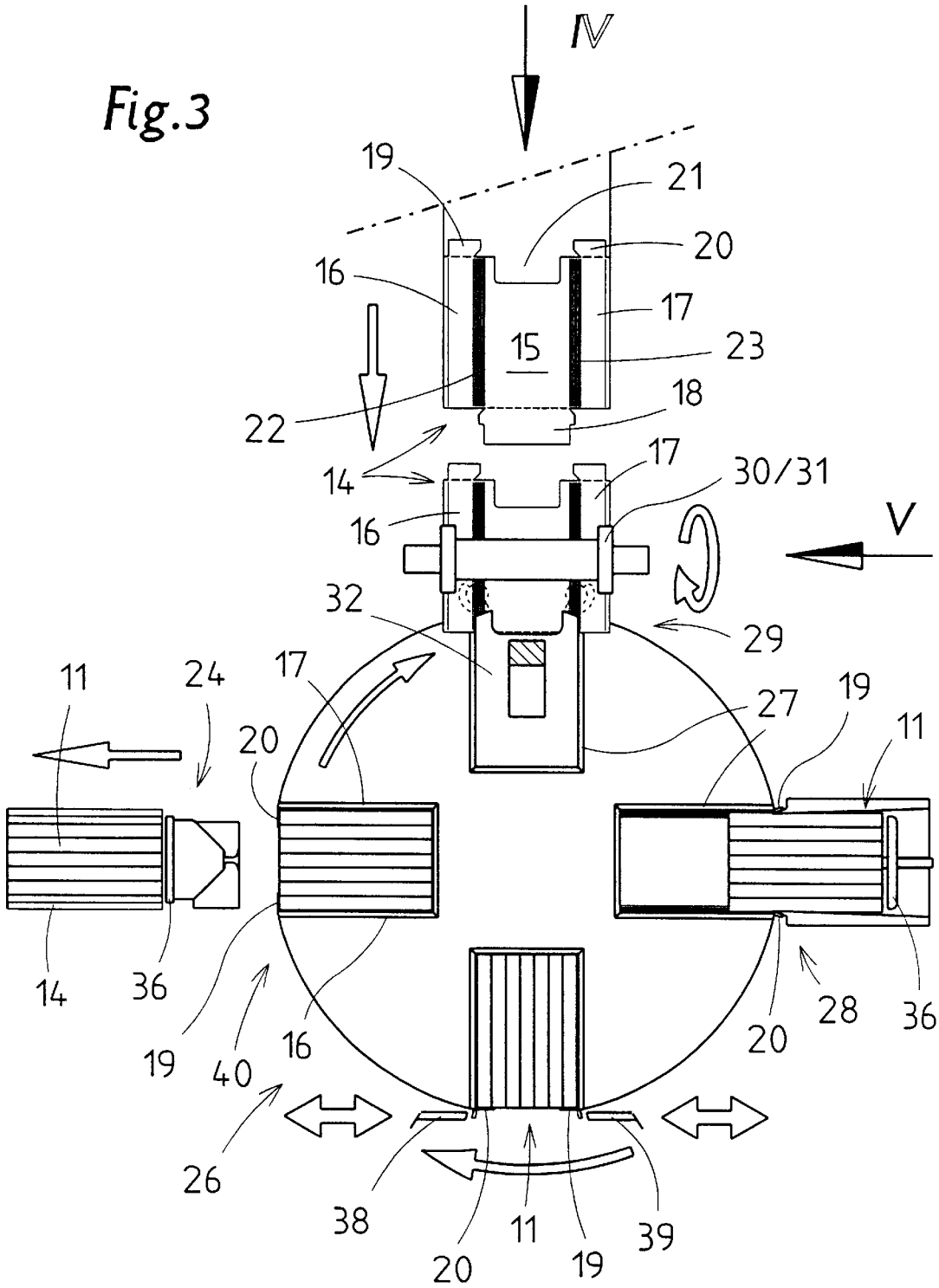
FIG. 3 shows, on an enlarged scale, a detail of the apparatus according to FIGS. 1 and 2, namely a folding turret in plan view.
Figure 6:
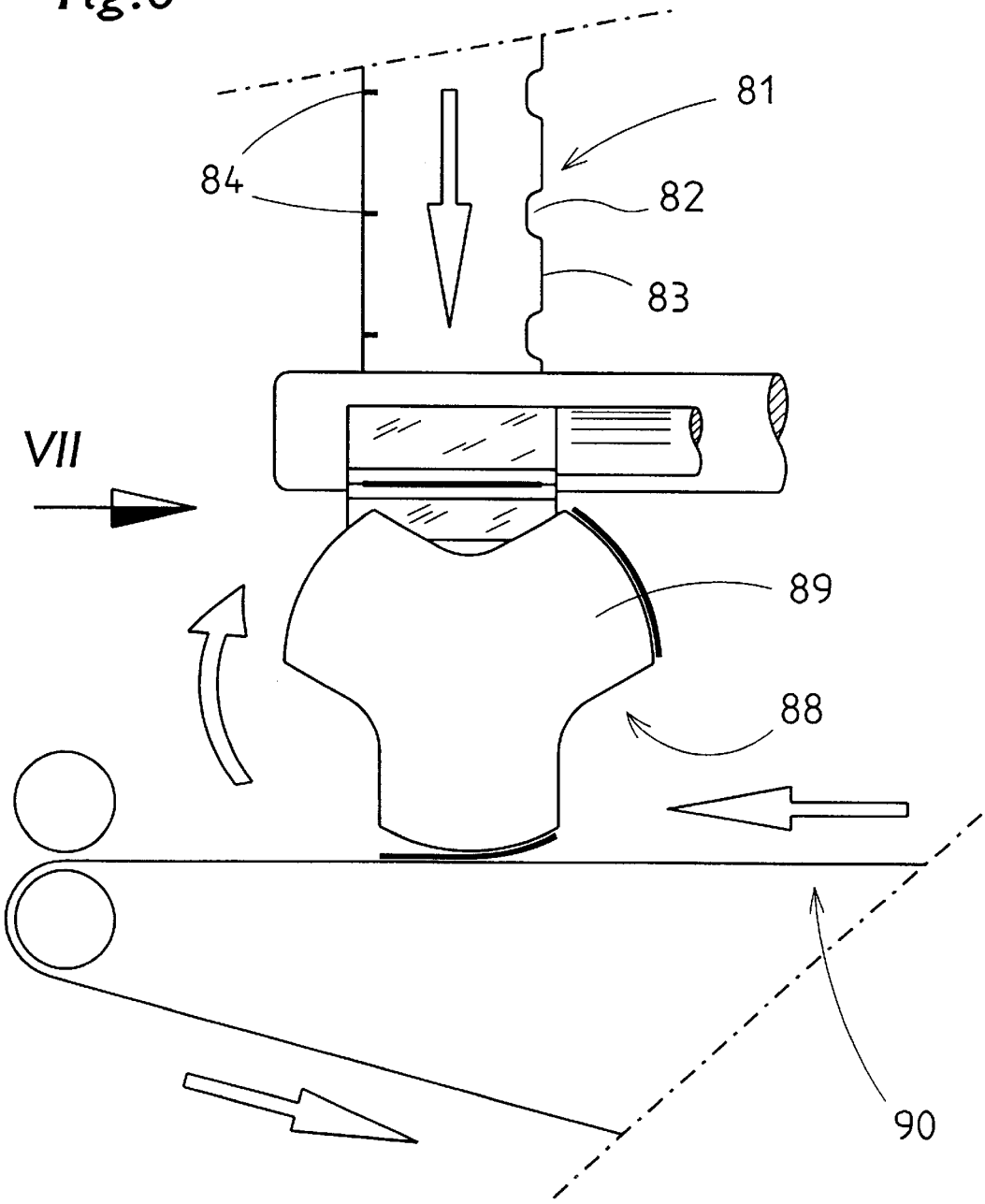
FIG. 6 shows, on an enlarged scale, a detail of the feeding of a material web, namely part of the illustration according to FIG. 2.
Figure 7:
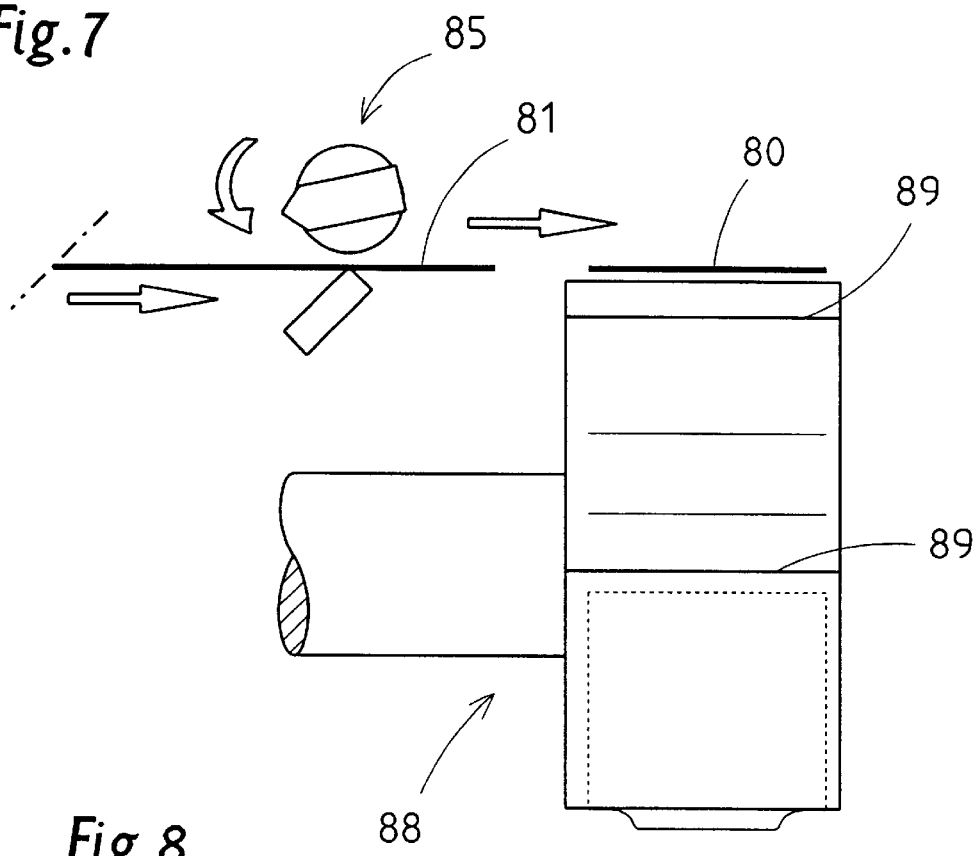
FIG. 7 shows the detail according to FIG. 6 in a transverse view in accordance with arrow VII in FIG. 6.
Figure 8:
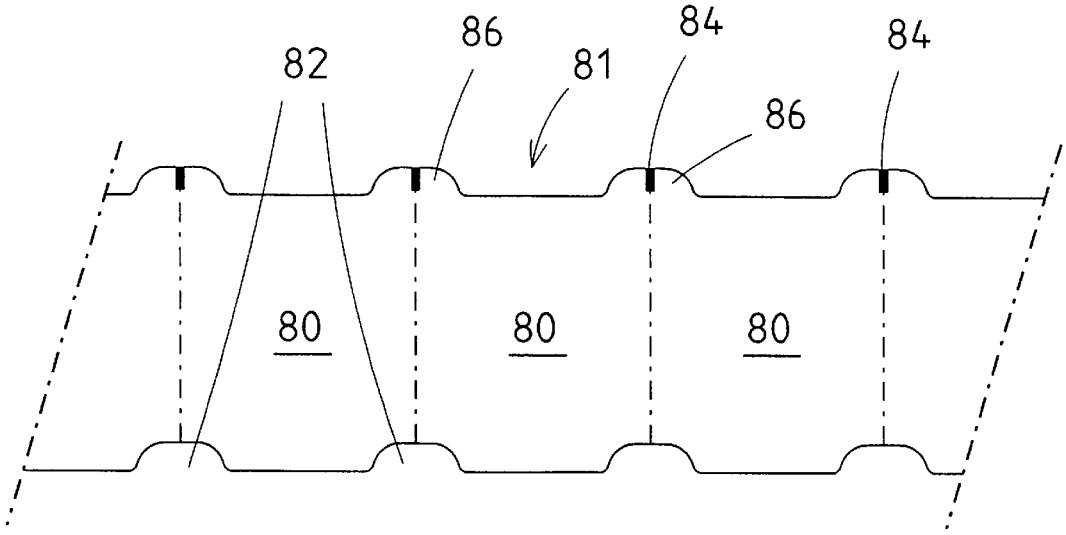
FIG. 8 shows a section of a material web for the production of closure tapes.
Figure 9:
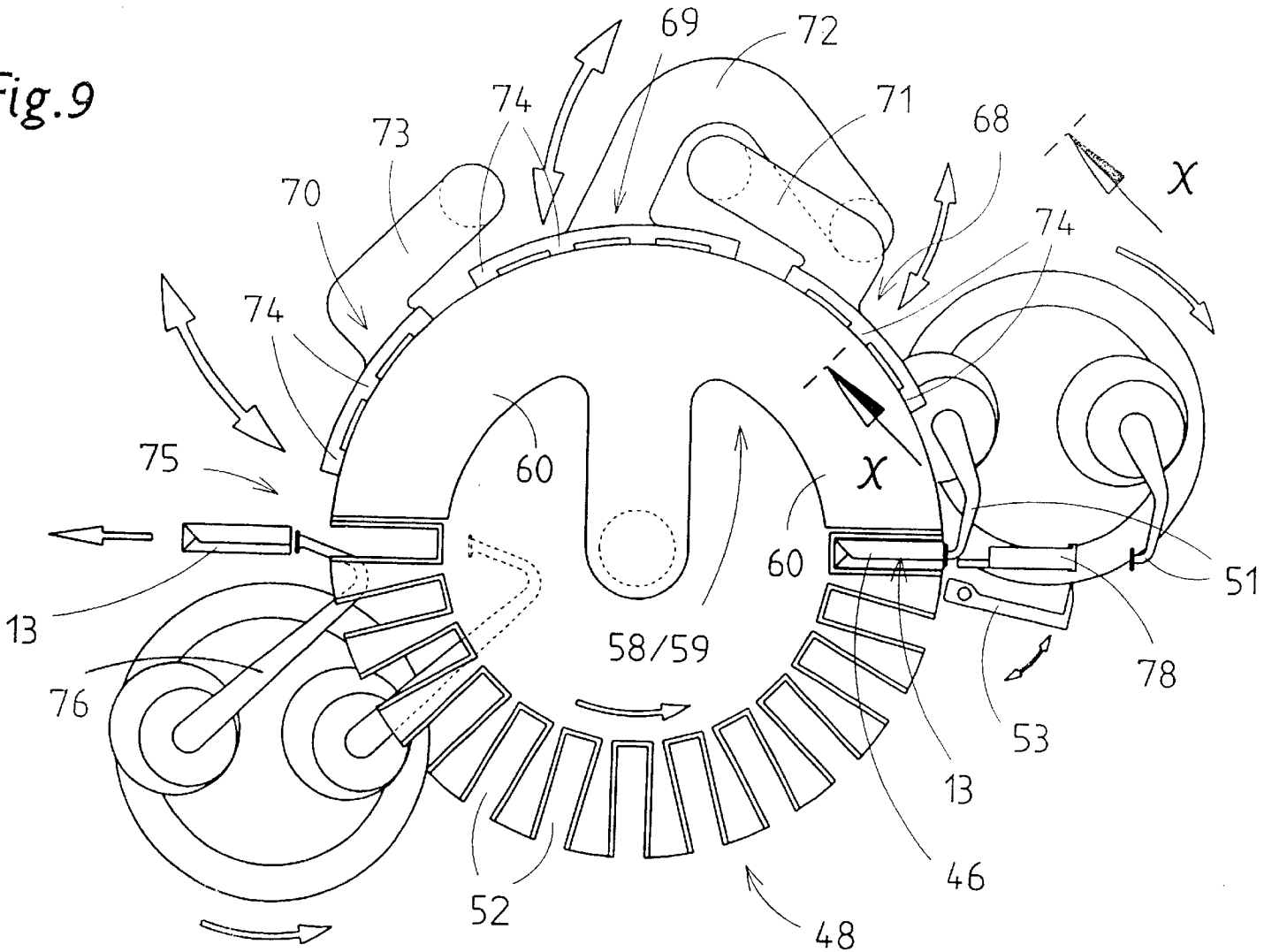
FIG. 9 shows a sealing station, namely a sealing turret for the inner wrapper in side view.
Figure 10:
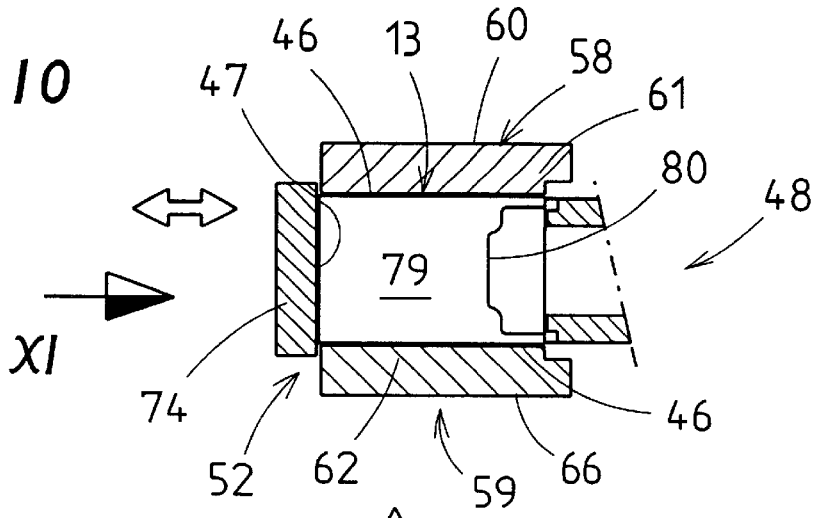
FIG. 10 shows a detail of the sealing turret, namely a pocket of the same along a section plane X—X from FIG. 9.

FIGS. 6, 7 and 8 show special features as far as the configuration and application of the adhesive label 80 are concerned. Said adhesive label is accordingly severed from a continuous material web 81. In the design according to FIG. 2, said material web 81 is provided, in accordance with the configuration of the adhesive labels 80 which are to be produced, with a rectilinearly running edge at one border. Depressions 82 are formed on the opposite side, and these define a correspondingly formed grip tab 83. Severing cuts for producing the individual adhesive labels 80 are made in the transverse direction in each case in the center of the depressions 82. Provided for this purpose on the opposite border of the material web 81 is a printed mark 84 which ensures a precise severing cut in the region of a cutting apparatus 85. Accordingly, the latter is controlled by the printed marks 84.

Another design of the material web 81 and/or of the adhesive labels 80 is shown in FIG. 8. Both longitudinal borders of the material web 81 are contoured, with the result that a plurality of material webs 81 located one beside the other can be produced without waste from a large web of corresponding design. Arranged opposite the depressions 82 are analogously designed protrusions 86. In this case, the printed marks 84 are positioned centrally in the region of the protrusions 86. The position of the severing cut is given in each case by chain-dotted lines.

The apparatus is designed such that the adhesive labels 80 severed one after the other from the material web 81 are fed to a sheet-material web 87 and are applied thereto. The sheet-material web 87 serves for producing the blanks for the wrapper 12. The adhesive labels 80 are applied to the sheet-material web 87 such that the blanks resulting from the severing cuts, and intended for the wrappers 12, have the adhesive label 80 in a precise position.

The individual adhesive labels 80 released by the cutting apparatus 85 are received by an intermediate conveyor, namely by a segment roller 88. The latter is provided along the circumference with a plurality of, in the present case three, retaining segments 89 each for one adhesive label. The adhesive labels 80 are fixed releasably on the retaining segments 89 by way of an outwardly oriented adhesive layer, to be precise using suction air via suction bores (not shown).

The segment roller 88 is positioned adjacent to the sheet-material web 87. The latter is guided by deflecting rollers such that a horizontally running conveying section 90 is formed. In the region of the latter, the adhesive labels 80 are transferred one after the other at appropriate intervals from the segment roller 88 to the sheet-material web 87. For this purpose, it is possible for the retaining force of the retaining segments 89 to be gradually eliminated. By virtue of convex abutment surfaces of the retaining segments 89, the adhesive label is transferred to the sheet-material web 87 by a rolling movement, to be precise with a front region, as seen in the conveying direction, first.

The sheet-material web 87 prepared in this way is fed over further deflecting rollers to the blank station 41. The latter is designed, in principle, in a conventional manner, that is to say it is provided with cutting rollers which sever the blanks for the wrapper 12 in a precisely positioned manner and hold them at the ready for being received by the cigarette group 11.

The elements for handling the sheet-material web 87 and the adhesive labels 80 are positioned above the movement path of the cigarette groups 11 and/or above the conveyor 37.

LIST OF DESIGNATIONS

10 Cigarette pack
11 Cigarette group
12 Wrapper
13 Cigarette block
14 Supporting insert
15 Front wall
16 Side tab
17 Side tab
18 Base wall
19 End tab
20 End tab
21 Cutout
22 Round edge
23 Round edge
24 Pack path
25 Cigarette turret
26 Folding turret
27 Pocket
28 Push-in station
29 Blank station
30 Conveying roller
31 Conveying roller
32 Ram
33 Guide element
34 Adjusting extension
35 Folding roller
36 Carry-along element
37 Conveyor
38 Folding finger
39 Folding finger
40 Push-out station
41 Blank station
42 Base wall
43 Corner tab
44 Side tab
45 Side tab
46 Side wall
47 End wall
48 Sealing turret
49 Longitudinal tab
50 Longitudinal tab
51 Pusher
52 Pocket
53 Folder
54 Folding gusset
55 Corner tab
56 Corner tab
57 Folding gusset
58 Sealing tool
59 Sealing tool
60 Segment
61 Sealing jaw
62 Sealing jaw
63 Shaping jaw
64 Shaping jaw
65 Round edge
66 Protrusion
67 Cutout
68 Sealing element
69 Sealing element
70 Sealing element
71 Pivoting arm
72 Pivoting arm
73 Pivoting arm
74 Sealing jaw
75 Push-out station
76 Pusher
77 Folding turret
78 Folding platform
79 Front wall
80 Adhesive label
81 Material web
82 Depression
83 Grip tab
84 Printed mark
85 Cutting apparatus
86 Protrusion
87 Sheet-material web
88 Segment roller

89 Retaining segment
90 Conveying section

What is claimed is:

1. A process for producing cigarette packs having as their pack contents a cigarette block, the cigarette block including a cigarette group and a wrapper made of heat-sealable film that completely surrounds the cigarette group, with a U-shaped supporting insert being arranged within the cigarette block and covering the front side of the cigarette group with a front wall and the side surfaces of the cigarette group with side tabs, the process comprising the following steps:

transporting the cigarette group through a plurality of stations along a rectilinear pack path until the cigarette block is completed;

feeding a blank for the supporting insert in a push-in station, wherein the blank for the supporting insert is fed transverse to the pack path and to a first folding turret in the region of the pack path, the blank folded into a U-shape in a pocket of the first folding turret;

inserting into the pocket of the first folding turret a cigarette group in the conveying direction of the pack path;

feeding along the pack path the cigarette group and supporting insert, wherein upon being pushed out of the first folding turret as a unit, the cigarette group and supporting insert are fed along the pack path to a blank station in whose region a wrapper blank for the wrapper is first folded around the unit of the cigarette group and supporting insert, forming the cigarette block;

transporting through a sealing turret the cigarette block, in which folding tabs of the wrapper are joined by heat-sealing; and feeding from the sealing turret the finished cigarette blocks along the pack path to a second folding turret for the production of the cigarette pack.

2. Process according to claim 1, wherein end tabs attached to the supporting insert first project from the pocket in the region of the first folding turret and, after the cigarette group is pushed into a partially folded supporting insert, are folded in the region of the first folding turret by folding fingers against the free ends of the cigarette group.

3. Process according to claim 2, wherein the end tabs attach to side tabs of the supporting insert.

4. Process according to claim 1, wherein blanks for the supporting insert are transported in a direction radial to the first folding turret to a position above the pocket of the first folding turret, and are then pressed by a ram into the upwardly open pocket by means of a downward movement that folds side tabs of the supporting insert and folds a radially inner base wall of the supporting insert in such a manner that a front wall of the of the supporting insert lies against a bottom surface of the pocket.

5. Process according to claim 1, wherein during the further transport of the unit including the cigarette group and supporting insert, a base wall of the supporting insert raised upright during the insertion of the blanks for the supporting insert into the pocket of the first folding turret is positioned at the rear side of the cigarette group as seen in the conveying direction due to being pushed out of the pocket of the first folding turret in the radial direction, and wherein during transport of the unit including the cigarette group and supporting insert, the wrapper blank for the wrapper is wrapped in a U-shape around the unit including the cigarette group and supporting insert in such a manner that folding tabs of the wrapper project at the rear past the cigarette group and supporting insert, and wherein a lower longitudinal tab of the base wall of the supporting insert is first folded by a displaceable folder against the rear ends of the cigarette group, while taking along and placing the base wall of the supporting insert in an upright position.

6. Process according to claim 5, wherein the folding tabs of the wrapper are folding tabs of a base wall of the wrapper.

7. Process according to claim 5, wherein the folding tabs of the wrapper are folding tabs of an end wall of the wrapper.

8. Process according to claim 1, wherein the wrapper blank for the wrapper has on its outer side an adhesive label serving as an opening aid for the wrapper, adhesive labels being severed in succession from a material web that exhibits the contours of the adhesive label, the adhesive labels put on a sheet-material web for making wrapper blanks for the wrapper in such a way that each wrapper blank for the wrapper severed from the material web has an adhesive label.

9. Process according to claim 8, the adhesive labels adhesively attached to the sheet-material web.

10. Process according to claim 1, wherein during transport of the cigarette group along the pack path, the wrapper blank for the wrapper is folded around the cigarette group such that folding tabs for forming an end wall of the wrapper extend past the cigarette group to the rear as seen in the conveying direction, and wherein during transport an inner longitudinal tab of the wrapper lying below with respect to the pack path is first folded against the rear ends of the cigarette group, and wherein upright corner tabs of the wrapper, with respect to the pack path, formed in the region of side walls of the wrapper are then folded against the rear side of the cigarette group, and wherein an outer longitudinally tab of the wrapper lying above with respect to the pack path is folded against the cigarette group.

11. Process according to claim 10, wherein the upright corner tabs of the wrapper are folded against the already folded inner longitudinal tab.

12. Process according to claim 10, wherein the outer longitudinally tab of the wrapper is folded against the corner tabs of the wrapper.

13. Process according to claim 10, wherein the outer longitudinally tab of the wrapper is folded against the already folded inner longitudinal tab.

14. Process according to claim 1, wherein the step of inserting into the pocket of the first folding turret a cigarette group in the conveying direction of the pack path occurs in the push-in station.

15. Process according to claim 1, wherein the folding tabs of the wrapper in the step of transporting through a sealing turret the cigarette block are folding tabs in the region of a base wall of the wrapper and in the region of side walls of the wrapper.

16. Process according to claim 1, wherein the U-shaped supporting insert is made of thin cardboard.

* * * * *